United States Patent [19]

Sato et al.

[11] 4,061,164

[45] Dec. 6, 1977

[54] POWDER FILLING MACHINE

[75] Inventors: Fumio Sato, Nishinomiya; Teruo Sakamoto, Hirakata; Seiichi Watashiro, Ikeda; Hayao Inoue, Osaka; Yoshihito Yahata, Kawanishi, all of Japan

[73] Assignee: Shionogi & Co., Ltd., Osaka, Japan

[21] Appl. No.: 730,447

[22] Filed: Oct. 7, 1976

[30] Foreign Application Priority Data

Nov. 13, 1975 Japan ..... 50-136727

[51] Int. Cl.[2] ..... B65B 1/04

[52] U.S. Cl. ..... 141/90; 141/152; 141/172; 141/177

[58] Field of Search ..... 141/37, 47, 48, 63, 141/64, 67, 59, 89–92, 144–152, 172, 177, 181–191, 250–284, 285

[56] References Cited

U.S. PATENT DOCUMENTS 2,295,529 9/1942 Gooden ..... 141/90

*Primary Examiner*—Houston S. Bell, Jr.

*Attorney, Agent, or Firm*—Birch, Stewart, Kolasch and Birch

[57] ABSTRACT

A composite measure of varying capacity, composed of supplying-aperture of straight cylinder and an inside measure telescopically inserted into the aperture and having a hollow of frusto-conical section, is employed in order to improve accommodation of the known conventional capacity type rotary powder filling machine, to powder of varying bulk density.

A turntable which receives the supplying-aperture, superimposes over another turntable which holds the inside measure, and the distance between the both, is adjustable during the operation in accordance with the variance in the bulk density. The height of the container transferring path is also adjustable simultaneously with that of the second turntable.

Spouting of compressed-air through an annular nozzle the diameter of which approximates to that of the aperture as a flow parallel to their inside wall is effected to blow off remaining powder in the measure and clean the same when the nozzle is disposed on the aperture.

Evacuation for removing air from an empty or partly filled container is made through an annular suction inlet capable of suctioning the air as a flow parallel to the inside wall of the container.

20 Claims, 13 Drawing Figures

POWDER FILLING MACHINE

BACKGROUND OF THE INVENTION

1. Field of the Invention

The present invention relates to an improvement in the powder filling machine of capacity type. Particularly, it is concerned with a machine capable of supplying each measured amount for a single shot of any powdery or particulate material of varying bulk density to a container transferred in succession to be placed underneath the measuring mechanism.

As is known, this type of powder filling machines have been and are now widely used by food or pharmaceutical manufacturers, because they are usually simpler in mechanism and less frequent trouble than those of weighing type. Among these, a vial filling machine is in practical use in pharmaceutical industry.

2. Description of the Prior Art

The known various vial filling machines of capacity type can be roughly classified into the following two groups, according to the difference in mode and means for measuring the powder to be filled and for supplying the measured powder to the container; one of which is based on a system comprising, suctioning the powder into a cylinder of a predetermined capacity radially disposed along a circumference of a vertically supported rotating disk and then pouring the measured amount of powder to a vial with gravity and pressure, and the other is based on a system comprising, rotating a compact screw feeder confined in a filling chute filled with powder for a predetermined turn or angle.

Of these known vial filling machines, the former one wherein the amount of powder to be filled for a single shot is determined by the fixed capacity of the cylinder, needs an interruption of the operation when the determined amount has to be changed.

In addition to this, such machines cannot prevent a large fluctuation (irregular level) in the amount for a single shot due to the difference in the bulk density of the powder to be filled, and this fluctuation cannot likewise be corrected without interrupting the filling operation.

Furthermore, since the measuring operation in accordance with this system is performed by direct levelling with a levelling blade adjacent to the rotating disk and the levelling may cause a contamination of the powder to be filled with any foreign particles, any countermeasure for such hazard has long been desired.

Conversely, if the filling operation is performed in accordance with the latter system wherein the change in the filling amount can be attained by varying the time period for actuating the rotating screw feeder, the correction can be made during the operation without interrupting it. The rotation of the screw feeder, however, may occasionally cause an adhesion of the powder, which may have various undesirable properties for instance, stickiness, to the feeder and other components inside the chute to result an unexpected and marked decrease in the filling amount. This is another undesirable feature causing serious fluctuations in the filling amount, inherent to this system.

Disadvantages in the actual filling operation which may be attributable to such defects of the known filling machines may easily be understood by any person skilled in the art.

SUMMARY OF THE INVENTION

It is therefore the primary object of the present invention to provide an improvement in powder filling machine of the capacity type which obviates the previously described drawbacks.

Another object is to provide a capacity type powder filling machine of an accuracy in the filling amount for a single shot which can bear comparison with the machine of weighing type.

A further object is to provide a powder filling machine which can handle powdery or particulate material of varying bulk density as that of even density.

A still further object is to provide a powder filling machine which can adjust the capacity of the measure, i.e., the amount to be filled for a single shot, during the continuance of the operation of the machine without any interruption.

A still further object is to provide a powder filling machine capable of performing the above-described functions with sufficient reliance and minimum maintenance service.

According to the present invention, there is provided an improvement in the powder filling machine of the type wherein, (A) distribution of the powder to each of measuring apertures aligned with constant spacings along a circle inside a circumference of a filling-turntable of flat surface rotatably supported around an upright center shaft mounted on a base of the machine of flat surface which also serves for carrying containers and equipped with a means for rotating the same, and (B) measurement of the amount of the powder to be filled for a single shot, are performed by (a) forming a heap of powder onto or around the aperture and then by (b) levelling off the heap with a reservoir for storing the powder mounted over the filling-turntable partly covering the surface of said turntable and having a closed side wall capable of (i) confining the powder within the reservoir and of (ii) levelling off the heap, and (C) sluicing-down of that measured amount of powder into an empty container placed underneath the measuring-aperture is effected by opening the usually shut bottom outlet of the aperture in a timed sequence and in accordance with their angular position when they are in vertically aligned relationship.

The provided improvement comprises;

1. a measure-holding turntable having substantially the same configuration as the superimposing filling-turntable, including measure-receiving openings which correspond to the measuring-apertures, and being supported coaxial and rotatable with the filling-turntable, but permitted of vertical displacement with respect to the filling-turntable.

2. a plurality of bottomless inner measures, each having a hollow of inverted frusto-conical section and a straight outer stem, the root portion of which is secured by each of said measure-receiving openings and the upper portion is telescopically inserted into each of the measuring-apertures to form a composite measure of varying capacity, and 3. a means for adjusting the height of the measure-holding turntable to vary the capacity of said composite measure which is dependent upon the distance between the turntables, simultaneously with that of the container placed underneath the aperture to combine the mouth of the container with the bottom of the aperture.

A combination comprising; (a) a cogged wheel supported around the center shaft between the measure-holding turntable and the base, rotatable with the turntables, and having a plurality of cogs, the numbers and respective positions of the dent between two adjacent cogs correspond to those of the measuring-apertures, (b) an arcuate guide plate installed on the base fencing a path for transferring the containers, to encircle the path with a space sufficient for receiving a container in the dent of the cogged wheel and the guide plate and (c) a container lifting cam embedded in the base along the transferring path for the containers having a plateau of a height sufficient for lifting the container to place underneath the measuring-aperture during the sluicing period, may be provided in order to place the empty container underneath the measuring-aperture.

The mentioned combination may further be associated with similar combinations of cogged wheels with guide plates for the purpose of passing empty containers to the first mentioned combination one by one and of removing filled containers likewise from the combination.

The height of the measure-holding turntable with respect to the base may preferably be adjusted simultaneously with that of the plateau of the container-lifting cam to maintain the distance between the measure-holding turntable and the plateau constant, during the continuance of the rotation of the turning elements. The adjustment may desirably be made automatically with the variance in the bulk density of the powder to be filled.

The air in the empty or partly filled container placed underneath the aperture may preferably be suctioned as a flow parallel to the inside wall of the container prior to or during the sluicing period.

A slider radially displaceable in a suspended position for shutting and opening the bottom outlet of each of the measuring-apertures may preferably be provided on the under surface of the measure-holding turntable. The slider may desirably have (a) a flat face which serves as a shutter for the bottom outlet, (b) a chute which serves to interconnect the opened outlet with the mouth of the container placed underneath the measure, and (c) a means for engaging itself with a cam mounted around the center shaft capable of effecting the radial displacement.

It may further have (a) an annular suction inlet encircling the chute and being accommodated to the inside diameter of the mouth of the container for evacuating the container, (b) an outwardly open outlet capable of accommodating itself to a suction junction of an exhausting means disposed outside the circumference of the turntable, and (c) a lengthwise conduit which connects (a) with (c) and permits the air to flow therethrough.

The annular suction inlet may preferably be formed as a narrow endless slit between the lower end portion of the chute and a packing ring of elastic material affixed to the bottom face of the slider to encircle the chute. The packing ring can absorb possible shock between the slider and the container and maintain airtightness therebetween.

The slider may preferably be displaced outwardly with a combination of a roller which follows a profile of the cam with any resilient means capable of exerting the slider an inward moment.

Another turning element of revolving turret being supported around the center shaft at its highest position and rotatable simultaneously with the turntables and associated with an outside compressed-air supplying equipment may preferably be included in the machine. The turret has a plurality of vertical cylinders, the numbers and respective positions of which are identical with those of the supplying apertures.

Each of said cylinders slidably supports a scavenging gun capable of (a) moving to its most descended position where a nozzle head affixed to its lower end contacts with the surface of the filling-turntable to cover the respective supplying-apparture and of (b) blowing off to clean the supplying-aperture and the components beneath the aperture with the compressed-air as a spout parallel to the inside wall of these components.

Each of the scavenging guns moves vertically by the rotation of the turret under the control of a cylindrical cam fixed to the center shaft. A distributor capable of supplying compressed-air from the associated supplying equipment to each of the scavenging guns is provided for spouting the air through the nozzle head in accordance with its angular and vertical positions in the timed sequence. It may include at least one control valve interposed between the compressed-air supplying equipment and each of the scavenging guns capable of regulating the spout of air through the nozzle head and being actuatable by the rotation of the turret.

The spout of the air from the nozzle head may preferably be an annual flow parallel to the inside wall of the nozzle head and this may effectively be attained by the provision of an annular slit which conforms to the diameter of the supplying-aperture, formed by a combination of the bottom opening of the nozzle head with a substantially cylindrical core suspended inside the opening.

At least the rigid lower end of the nozzle head may desirably be covered with a boot of elastic material capable of (a) absorbing shock caused by possible collision of the head with the surface of the filling-turntable and of (b) maintaining air-tightness between the head and the surface during a period wherein the gun is in its most descended position.

BRIEF DESCRIPTION OF THE DRAWINGS

In the following paragraphs, the construction of the apparatus built in accordance with the present invention will be described in detail by way of example shown in the accompanying drawings, wherein a plurality of parts or components having identical or similar functions are designated by identical or similar reference characters and/or numerals throughout several views and.

DESCRIPTION OF THE PREFERRED EMBODIMENT

Figure 1:
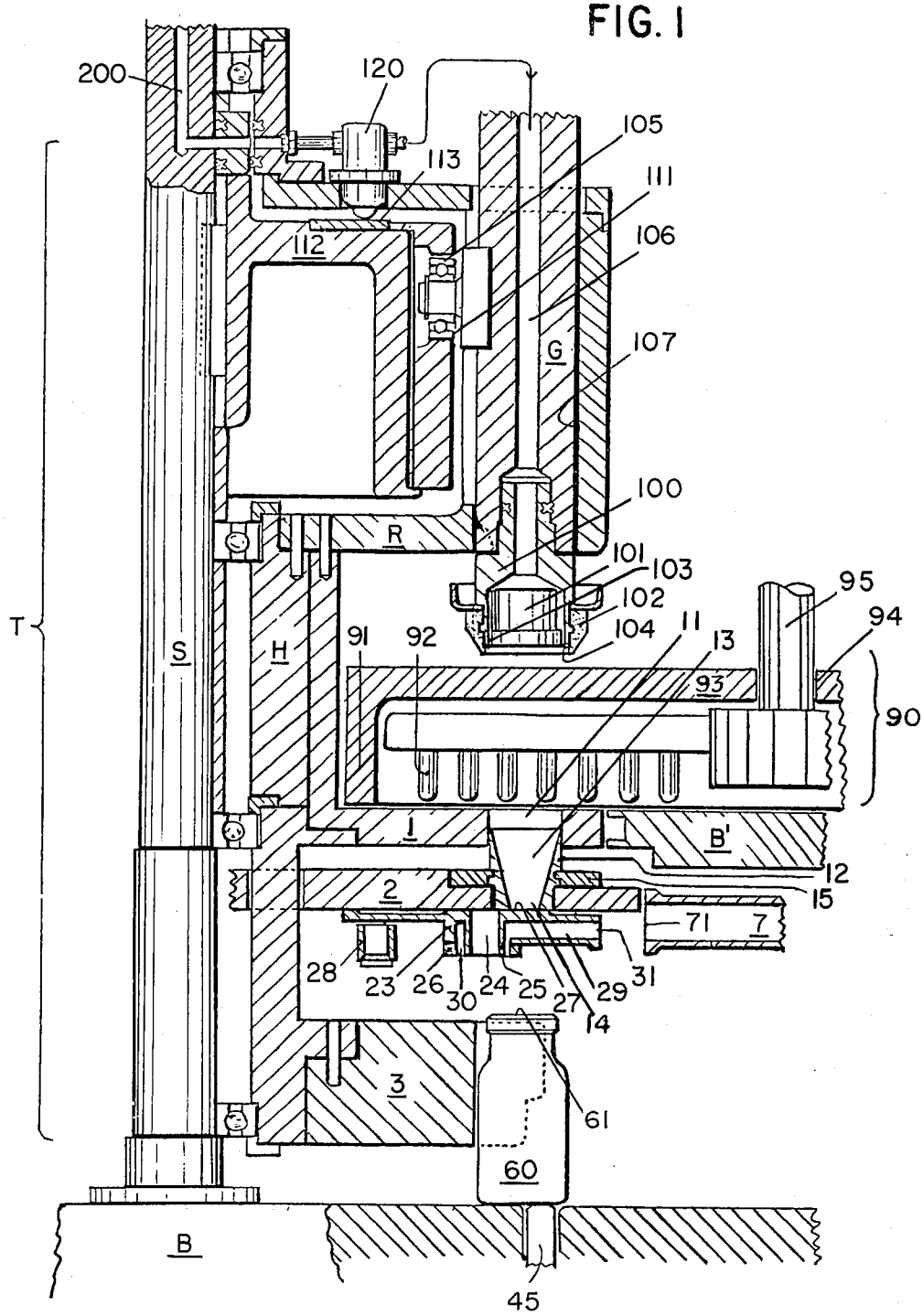
FIG. 1, is a partly sectional side view showing a powder filling machine embodying the present invention including components of optional features and function.

Typical aspect of the powder filling machine embodying the present invention is shown in FIG. 1 wherein I designates a compound turning body composed of a revolving turret R, a filling-turntable 1, a measure-holding turntable 2, container carrying cogged wheel 3 and a common hub H which is rotatable about a main shaft S being upright at a center of the machine base B.

The common hub H secures said filling-turntable 1 and cogged wheel 3 integrally, and carries said turret R thereon as well as said measure-holding turntable 2, permitting its vertical movement between the filling-turntable 1 and the cogged wheel 3.

A plurality (18, shown in the drawings) of supplying-apertures 11 and the same numbers of measure-receiving openings 21, each having a coincidence in its circular shape and a common horizontal position, are provided with a given constant spacings along circles inside the circumferences of the turntables 1 and 2, respectively, An inner measure 12 having a cylindrical outer stem the diameter of which conforms to that of the supplying-aperture 11 and a hollow 13 of an inverted frusto-conical shape is telescopically inserted into each of the appartures 11, and is held by the openings 21 at its root portion with a bracket 15 so as to bridge both turntables 1 and 2.

This combination of the inner measure 12 and the supplying aperture 11, the former is telescopically inserted into the latter, forms a supplying cavity, a composite measure, the capacity of which can easily be adjusted by varying the distance between both turntables, usually by lifting the measure-holding turntable 2 within a range determined by the thickness of the filling-turntable 1.

It is to be noted here that the measure 12 should be designed such that the diameter of its inlet or upper end of the hollow 13 equals to that of the supplying-aperture 11 in a manner no shoulder which might cause a stagnation of powdery material would not be formed at the border between the inner walls of the measure 12 and the aperture 11; in other words, the joined inner surface of the composite measure should be finished as smooth as possible.

Figure 4:
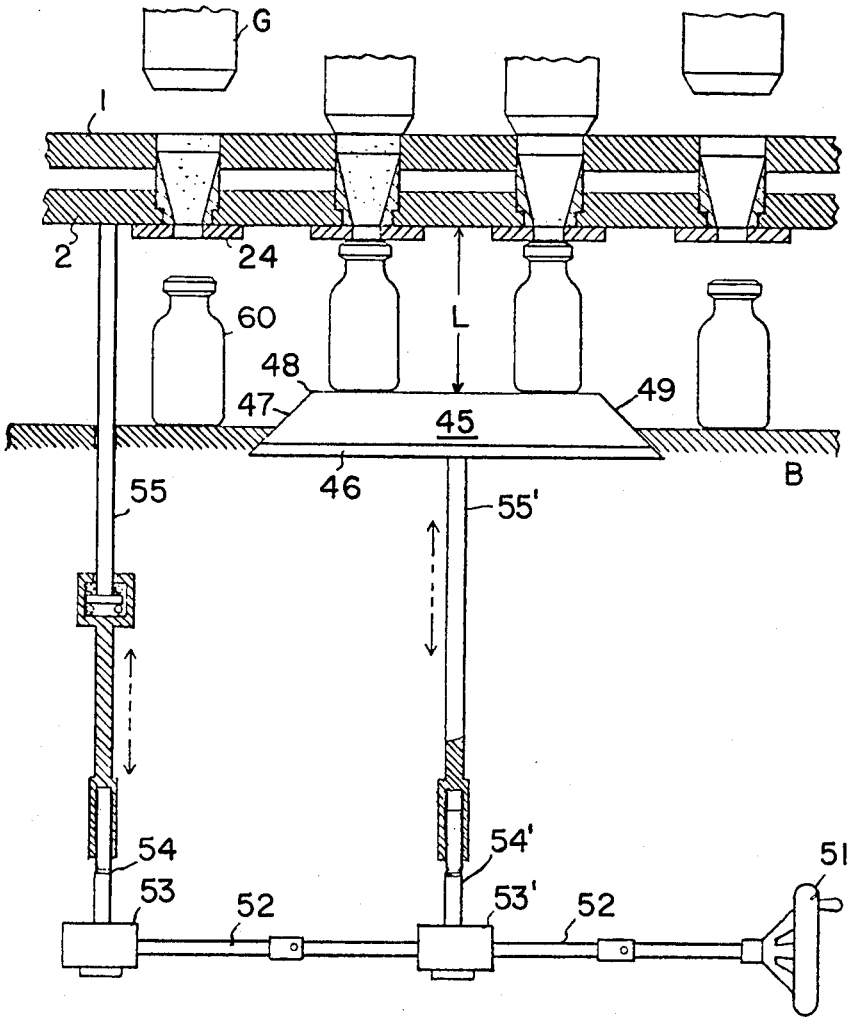
FIG. 4, is a partly sectional side view showing a combination for adjusting the heights of the measure-holding turntable and the container-lifting cam.

The measure-holding turntable 2 may be lifted by, for instance, a mechanical means shown in FIG. 4 wherein the rotation of a horizontal shaft 52 manually operable with a handle 51 is converted through worm-gear boxes 53 and 53' into rotation of vertical shafts 54 and 54' which are threaded into root portions of push rods 55 and 55' to give rise to their lengthwise movements.

These lengthwise movements adjust the heights of the measure-holding turntable 2 and a cam 45, with respect to the supplying turntable 1.

A slider 23 slidably suspended from the bottom face of the measure-holding turntable 2 in juxtaposition, carries filling chute 24 which opens its upper end at the plane identical with that of the outlet 14 of the corresponding measure 12. The slider 23 which usually shuts the bottom outlet 14 of the measure 12 with its upper flat face 27, can move radially to the right of drawings to align the center of the measure 13 with that of the filling chute 24, whereupon the chute 24 can interconnect the measure 12 with a container 60 when the latter is sufficiently lifted.

The movement of the slider 23 is effected in a timed relationship with the rotation of the turntables 1 and 2 by a roller 28 mounted on an end thereof which follows a profile of a cam (not shown) mounted on a stationary portion of the apparatus.

The slider 23 also contains (a) an annular suction inlet 30 encircling the lower end portion 25 of the chute 24 and being accommodated to the inside diameter of the container 60, (b) an outwardly open outlet 31 at the outside end thereof capable of accommodating itself to a suction junction 71 of an exhaust adapter 7 disposed outside the circumference of the turntable, and (c) a lengthwide conduit 29 connecting (a) with (b) which permits a flow of the air therethrough. A packing ring 26 is affixed to the bottom face of the slider 23 so as to encircle the annular suction inlet 30. It can stick fast to a mouth 61 air-tightly and absorb possible shock when the container 60 is lifted over a plateau 48 of a cam 45 by the rotation of the cogged wheel 3 and the chute 24 is aligned with the container 60.

The annular suction inlet 30 and the lower end 25 of the chute 24 may be arranged such that the former can open on to the mouth 61 of the container 60 and the lower end 25 is preferably at a plane of the inlet 30 or somewhat lower than that.

The outlet 31 of the conduit 29 can join itself onto the suction junction 71 of an exhaust adapter 7 which is provided on a stationary portion of the machine and is connected to an outside suctioning means (not shown) to permit the passage of air therethrough, when the chute 25 is brought to align with the outlet 14 of the measure 12. The evacuation for removing air from the container 60 through the suction inlet 30 may preferably be initiated prior to the filling operation of powder into the container 60.

The container-carrying cogged wheel 3 carries, in its dents between two adjacent cogs 33 arranged along its circumference, a plurality of the containers 60 gliding on the base B, one by one in a timed and spaced relationship while holding them in the dents and a guide plate 80 encircling the wheel 3. (FIG. 2).

Figure 2:
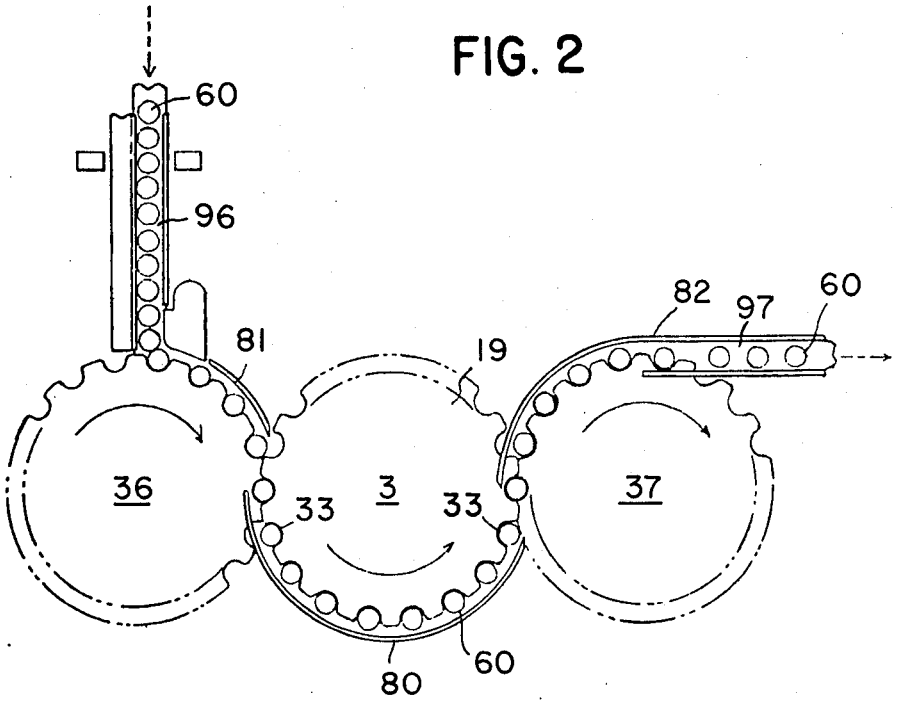
FIG. 2, is a plan view showing a combination forming a path for transferring containers.

It receives the empty containers from an associated combination of a similar cogged wheel 36 and a guide plate 81 from the left of FIG. 2 and releases the filled containers to another associated combination of a cogged wheel 37 and a guide plate 82 tangentially to the right; both wheels 36 and 37 rotate in a timed relationship with the wheel 3.

Figure 3:
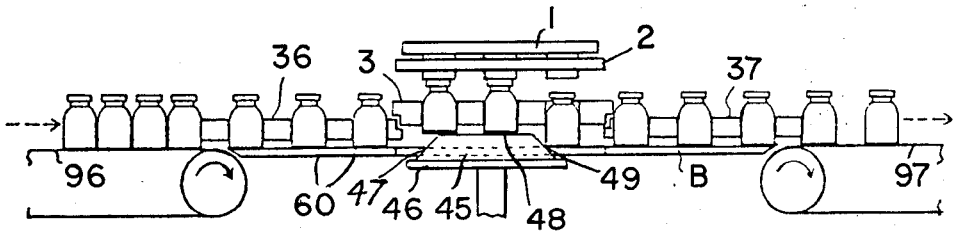
FIG. 3, is an extended side view of said combination.

The empty containers are supplied through a belt conveyor 96 to the cogged wheel 36, and the filled containers from the cogged wheel 37 are passed into another step through another conveyor 97. (FIG. 3).

The filling operation to each of the containers is performed while each container is transferred along the circumference of the cogged wheel 3 after the reception of an empty container by the cogged wheel 3 at the point of contact with the cogged wheel 36 until the release of the filled container at the point of contact with the cogged wheel 37, especially during a gliding of the container over a profile of a container lifting cam 45 forced by the rotation of the cogged wheel 3.

Namely, an arcuate transferring path 38 substantially along the circumference of the wheel 3 includes the container lifting cam 45 having a slope 47 capable of bringing the gliding container to its profile top (plateau) 48 where the mouth 61 of the container 60 touches to the packing ring 26.

After sluicing of powder P into the container performed during this period of gliding of the container 60 over the plateau 48 is completed, the container is lowered by gravity along a decline 49 to the initial height of the transferring path, and thereafter is released from the wheel 3 to the wheel 37.

As previously described, the cam 45 is associated with the turntable 2 in their height adjustments in order to always maintain the clearance L between the plateau 48 and the bottom face of the turntable 2 to be constant.

Possible minor irregularities in the height of the containers actually used, may be made harmless by a buffering action of a leaf spring 46 affixed to the cam 45.

A filling chamber 90 having a side wall 91 and a top lid 93 which serves as a support for a bearing 94 of a shaft 95 of a stirrer 92, is hung onto a stationary component of the apparatus to cover approximately ⅓ of the top face of the filling turntable 1 and a portion of a stationary table B' having a plane accommodated to encircle the turntable 1. The lower edge of the side wall 91 does not directly contact with the turntable 1 but virtually serves as a leveler for a heap of powder formed on or around the supplying aperture 11.

A feeder and/or a hopper and any anciliary equipment for supplying powder to the filling chamber 90 are also provided over the chamber, though these are omitted from the illustration because the structures of these are common to the known pharmaceutical processing apparatus such as tabletting machines.

A plurality of scavenging guns G each having a center air conduit 106, the numbers and respective positions of which correspond to those of the supplying appartures, are slidably supported by a vertical cylinder 107 provided on the revolving turret R along its circumference. The turret R rotates simultaneously with the other components of the turning body T.

The revolving turret R receives a supply of compressed-air from the center shaft S having a center conduit 200 which is connected to communicate with an outside supplying equipment, e.g., a plant compressed-air line (not shown), and distributes the air to each of the scavenging guns G in a timed sequence in accordance with the position of the gun G through a control valve 120 provided on a upper component of the turret R which valve being operable by a cam 113 on a stationary component 112 fixed around the center shaft S.

Each of the scavenging gun G comprises, a nozzle head 100 having a suspended cylindrical core 101 and a boot 102 of elastic material which covers at least rigid lower end 103 of the nozzle head 100 and serves as a buffer between the nozzle head and the top surface of the turntable 1 and as a seal for keeping air-tightness therebetween when the head 100 touches the turntable 1. This combination of the outlet 103 of the head 100 and the core 101 forms an annular slit 104, the diameter of which is approximately identical with that of the apparture 11, through which the compressed air blows off to sweep any remaining particles of powder from the inside measure 12 as a spout parallel to the inside wall of these components.

The scavenging gun G moves vertically as it is transferred along a circular path which is horizontally identical with that of the supplying aperture 11 of the turntable 1, by for instance roller 105 mounted on the side of the gun G which follows closely a groove 111 of a cylindrical cam 110 mounted on the stationary component 112 around the shaft S.

Since its vertical position is dependent upon its angular position, the blowing off or spout of the compressed-air through the annular slit 104 is effected under the control of the control valve 120, when it descends to reach to its lowest position.

The apparatus, the construction of which has briefly been discussed with particular reference to a unit including components having key functions, supported by the turning body T and rotatably disposed around the center shaft S, operates as follows.

FIGS. 5A–5H are drawings like FIG. 1, each illustrates each functional aspect of the apparatus, the relative positions of the components forming a unit with respect to the other, in sequential steps assigned to each angular position of the components in the turning body.

Figure 5A:
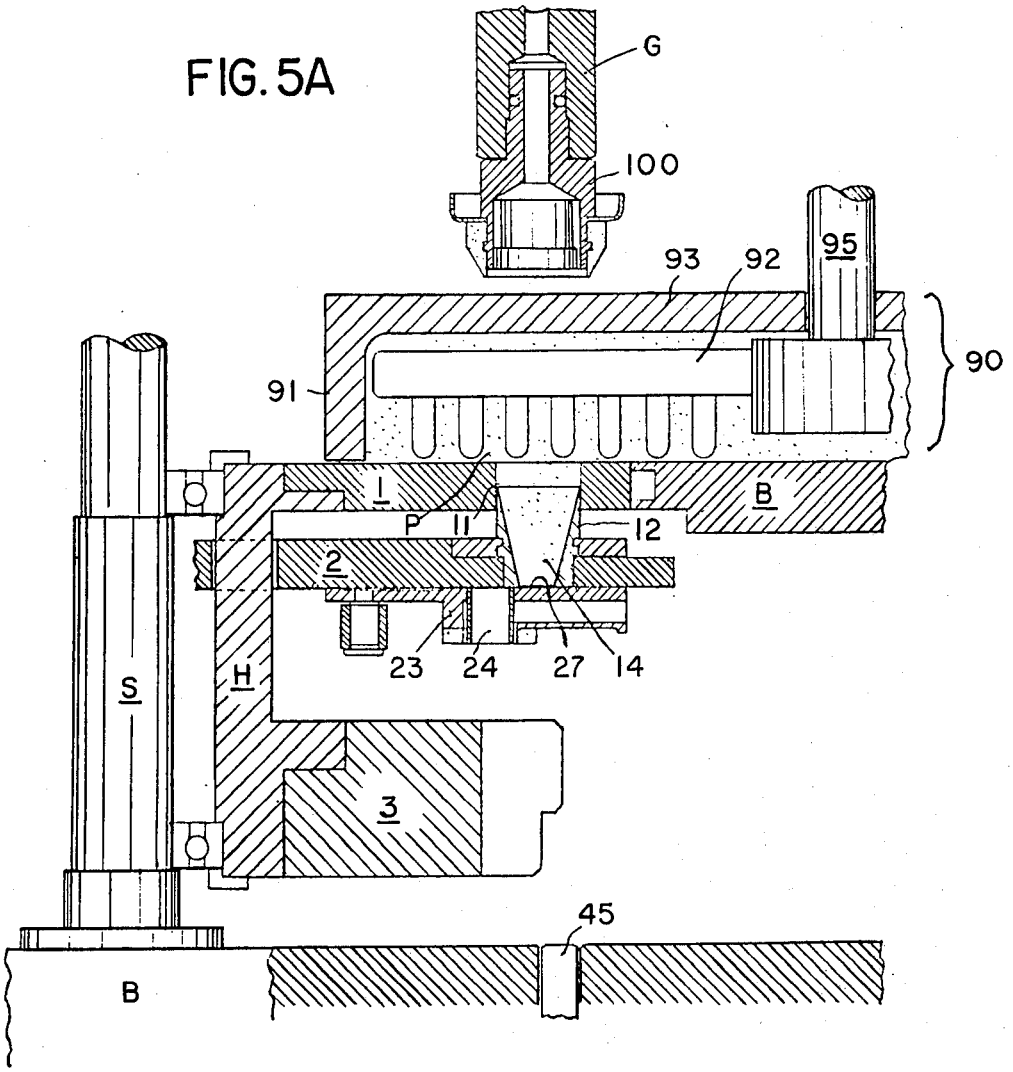
FIGS. 5A through 5H, are drawings like FIG. 1, each showing relative positions of the components in respective functional aspects.

In the first aspect shown in FIG. 5A, a composite measure composed of the supplying aperture 11 of the filling turntable 1 and the inner measure 12 is covered with the overhead filling chamber 90 filled with the powder P, wherein the outlet 14 of the measure 12 is shut by the flat face 27 of the slider 23, no empty container is carried by the cogs of the wheel 3, the scavenging gun G is held in its highest position and the control valve therefor is also closed.

Figure 5C:
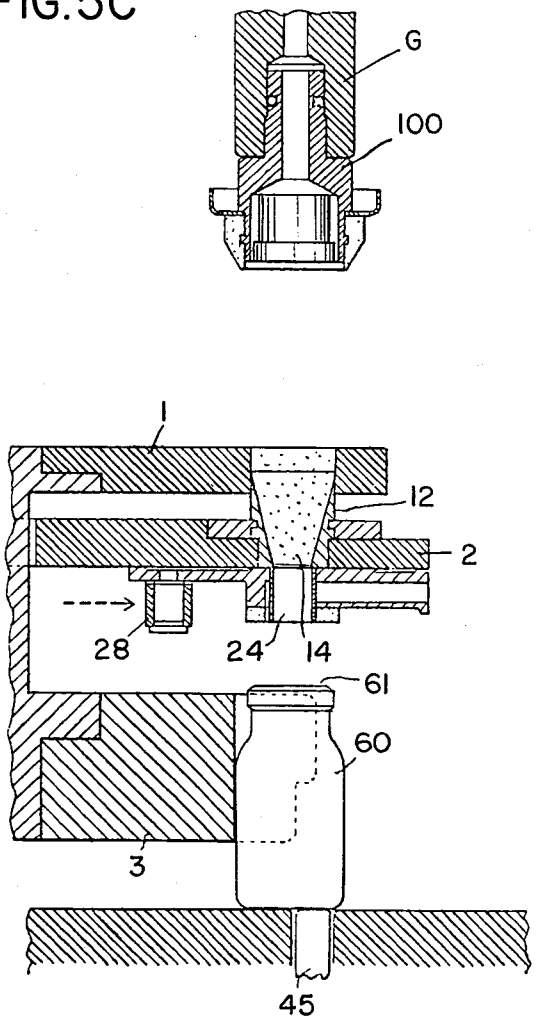
Figure 5B:
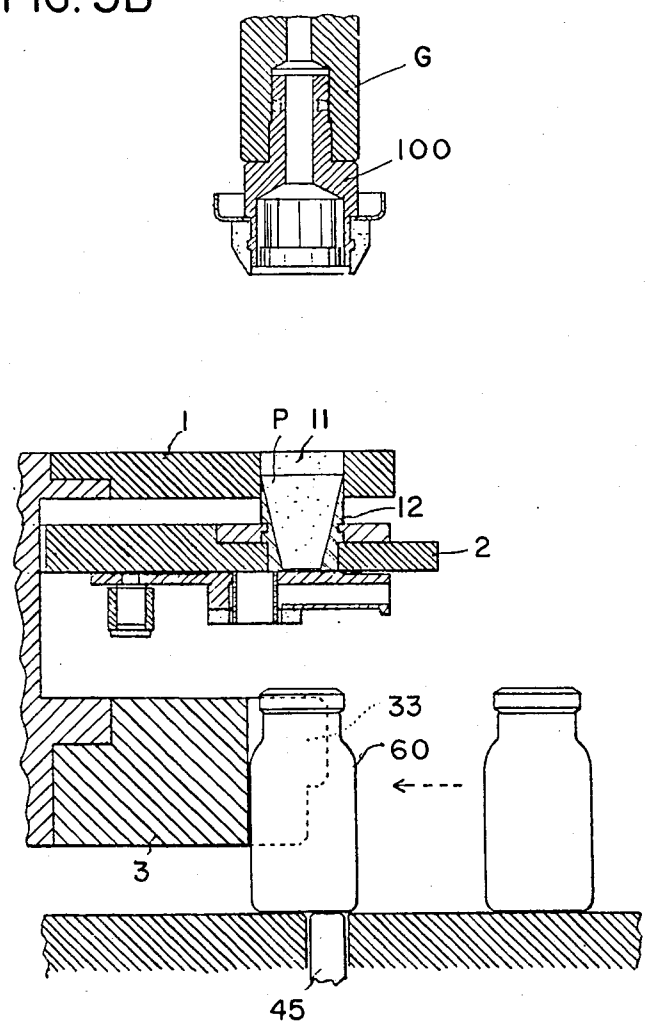

FIG. 5B, shows the second aspect wherein the supplying aperture 11 has just released from the coverage of the filling chamber 90 and the powder P in the aperture has just leveled off by the lower edge of the side wall 91 of the filling chamber 90.

In this aspect the empty container 60 which is passed from the cogged wheel 36 to the dent between the adjacent two cogs 33 of the wheel 3 is placed underneath aperture 11 and the inner measure 12.

In the third aspect shown in FIG. 5C, the slider 23 begins to move radially to align the center of its filling chute 24 with that of the outlet 14 of the measure 12 and the scavenging gun G begins to decend. In this aspect, major portion of the powder P in the measure 12 may sluice into the empty container 60 through the chute 24 by gravity.

Figure 5E:
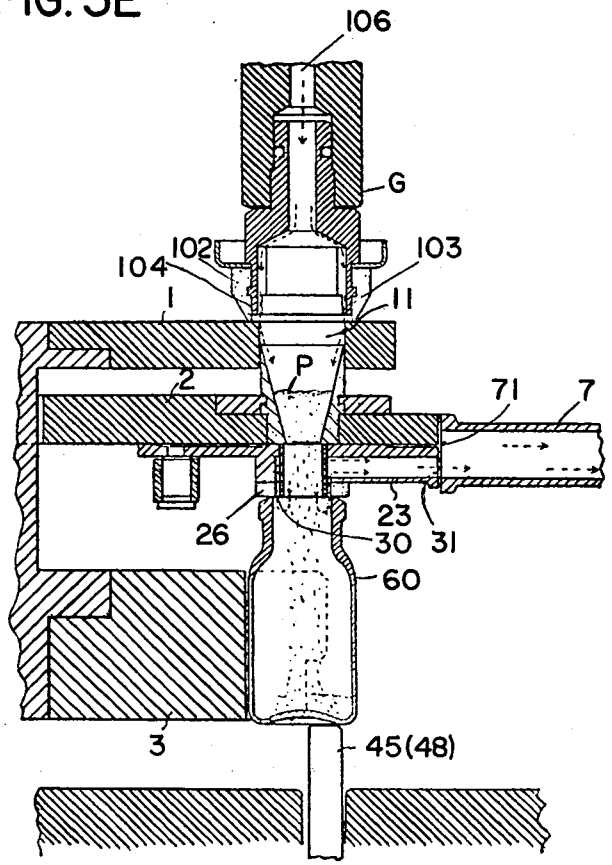
Figure 5D:
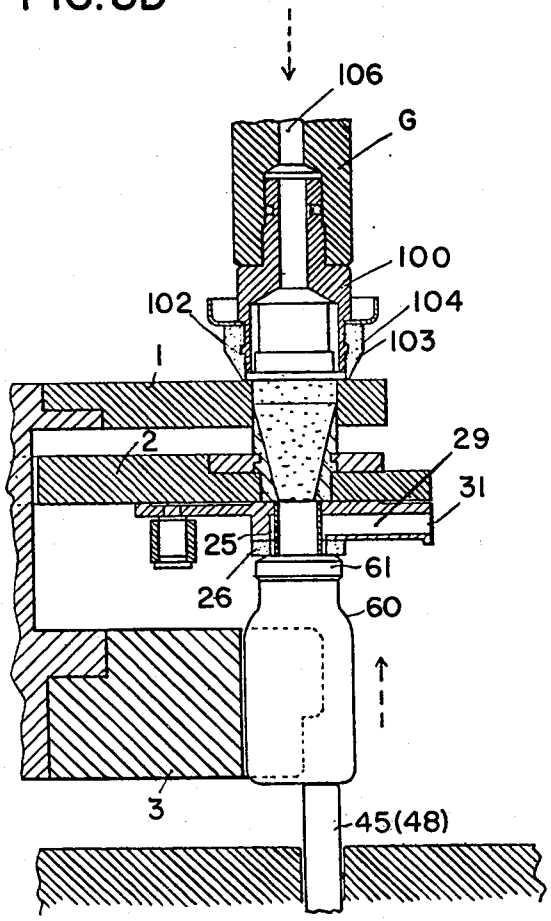

FIG. 5D shows the fourth aspect wherein the scavenging gun G reaches down to the surface of the turntable 1 and, in contrast, the container 60 is lifted up to make its mouth 61 to stick fast to the packing ring 26 of the chute 24.

The fourth aspect shift to the sixth aspect shown in FIG. 5E without changing the relative positions of the components except that a suction inlet 71 of the exhaust adapter 7 faces to the outlet of the exhaust pipe 31.

In this aspect, evacuation of the air from the partly filled container 60 begins through the annular suction inlet 30 and simultaneously or slightly after the initiation of the suction the control valve 120 associated with the scavenging gun G opens to blow air through the annular slit 104 to the aperture 11 and measure 12 to force the remaining particles in the measure 12 to place in the container 60 as designated by the dotted arrows in the drawing.

The blowing of air usually continues for about 0.2–1.0 seconds and this is sufficient for sweeping any remaining particles in the inner wall of the inverted frustoconical hollow 13 of the measure 12.

Figure 5G:
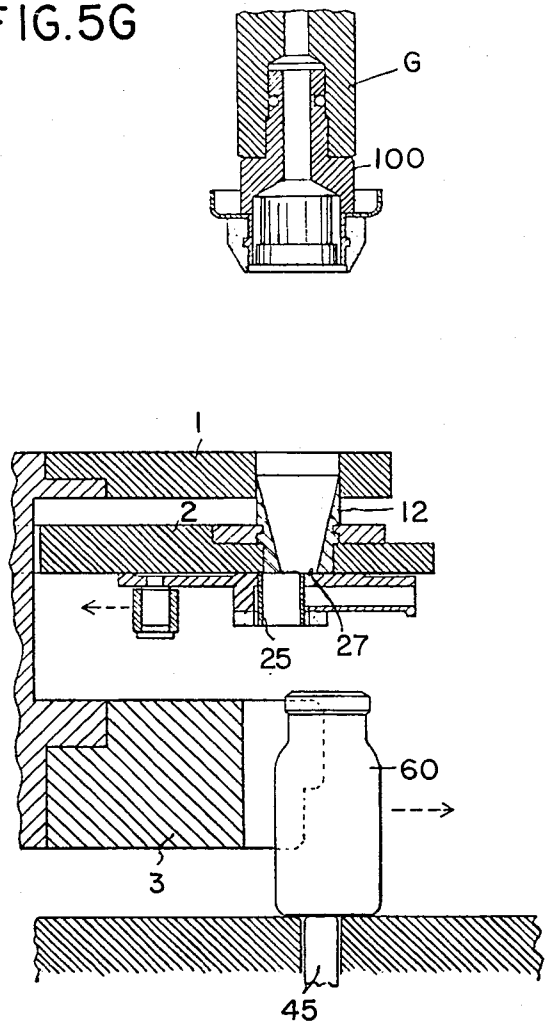
Figure 5F:
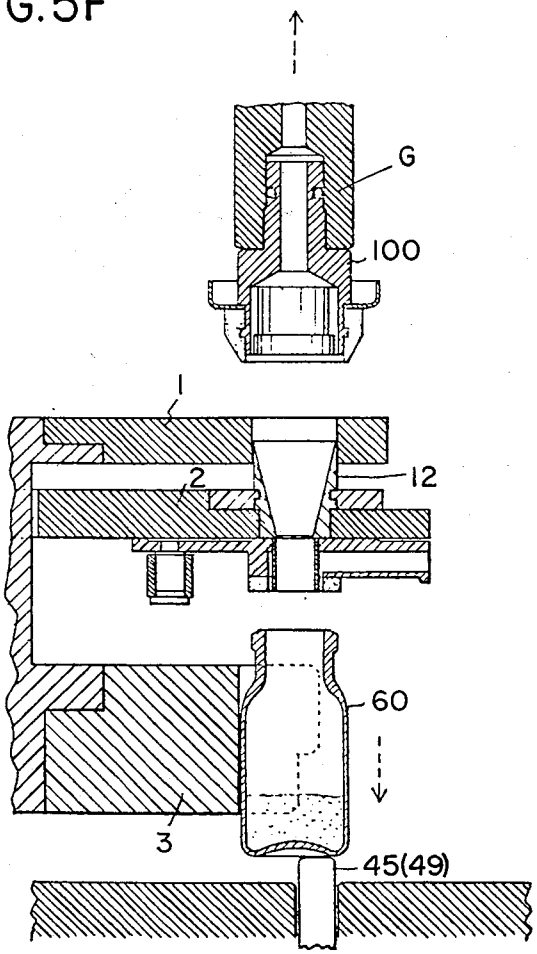

After filling operation, the scavenging gun G begins to ascend to its initial height and the filled container 60 continues to glide over the cam 45 (the plateau 48 and the decline 49) to descend to the initial height of its transferring path as shown in FIG. 5F (the sixth aspect).

Figure 5H:
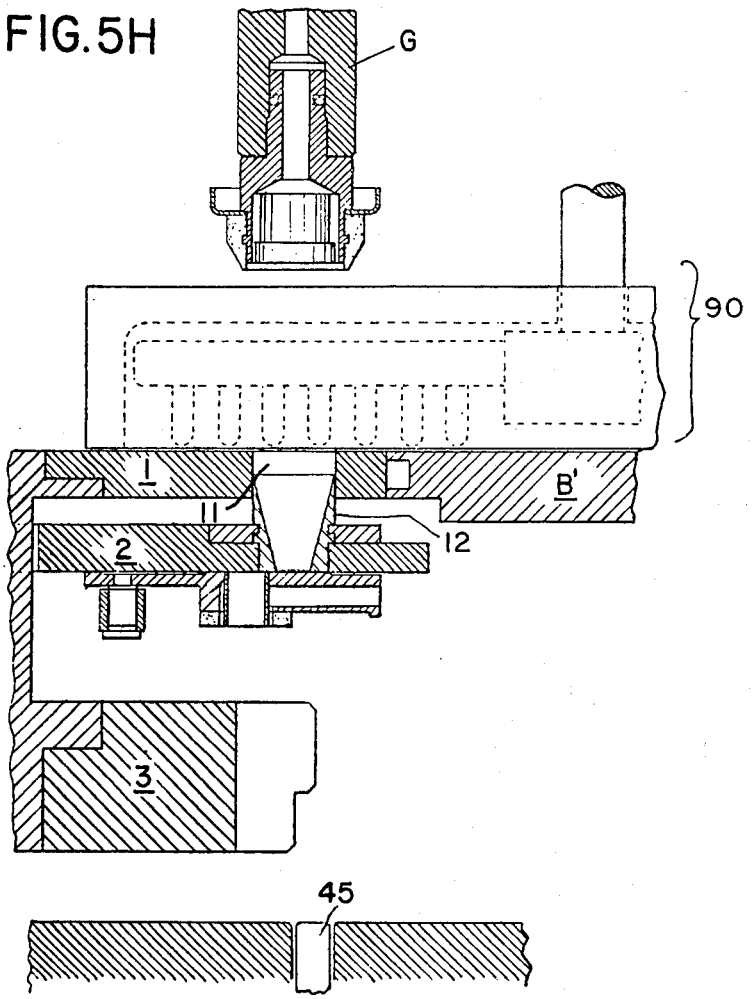

In the seventh aspect shown in FIG. 5G, the slider 23 begins to return to its initial position to shut the outlet 14 of the measure 12 and the filled container 60 is ready to be passed from the wheel 3 to the wheel 37, and then the relative positions of respective components shift to the eighth aspect shown in FIG. 5H capable of performing the next cycle.

Figure 6:
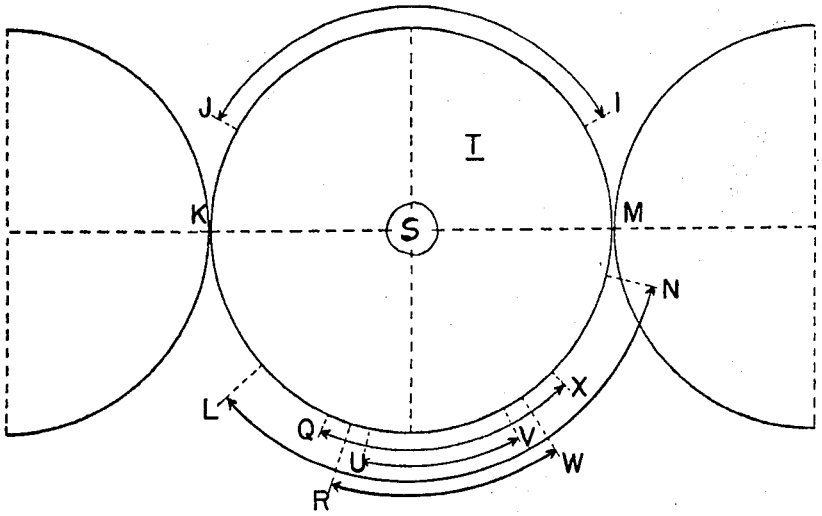
FIG. 6, is an example of a diagram planned for assigning respective functional aspects of FIGS. 5A through 5H to the components in sequential steps.

FIG. 6 is an example of diagram planned for assigning each of the previously-described aspects of the unit in accordance with its angular position in the turning body T rotatable about the center shaft S, wherein the angular position between points I-J is assigned to the supplying operation of powder from the filling chamber to the supplying-aperture 11 of the turntable 1 (the first aspect).

The angular position between points L and N is assigned to the radial outward displacement of the slider 23, which cause to align the filling chute 24 with the supplying aperture 11. At point Q, the scavenging gun G begins to descend and slightly afterwards, at point R, the empty container 60 is lifted to a position beneath the filling chute 24 (the forth aspect). Thereafter the evacuation of the air from the container begins.

During the period which corresponds to the angular position between points U and V, the actuation of the control valve for the scavenging gun G is effected to blow air through the ringed slit 104 (the fifth aspect). At point W, the filled container 60 begins to descend and at point X, the scavenging gun G begins to ascend to its initial positions respectively (the sixth aspect).

With this diagram, designing and manufacturing of various cams are per-se obvious to any person skilled in the art. The automatic adjustment of the capacity of the composite measure may easily be done by sensing the bulk density of the powder to be filled, deriving an electrical signal from the result of the sensing and actuating the horizontal shaft 52 of FIG. 4 by the derived signal.

The empty container 60 is supplied from the wheel 36 to the wheel 3 at point K and the filled container is passes to the wheel 37 at point M.

While a preferred embodiment of the present invention has been described using specific terms, such description is for illustrative purposes only, and it is to be understood that changes and variations may be made without departing from the spirit or scope of the following claims.

What we claim:

1. In the powder filling machine of the type wherein, (A) distribution of the powder to each of measuring-aperture aligned with constant spacings along a circle inside a circumference of a filling-turntable of flat surface rotatably supported around an upright center shaft mounted on a base of the machine of flat surface which also serves for carrying containers and equipped with a means for rotating the same, (B) measurement of the amount of the powder to be filled for a single shot, are performed by (a) forming a heap of powder into or around the aperture and then by (b) levelling off the heap with a reservoir for storing the powder mounted over the filling-turntable partly covering the surface of said turntable and having a closed side wall capable of (i) confining the powder within the reservoir and of (ii) levelling off the heap, and (C) sluicing-down of that measured amount of powder into an empty container placed underneath the measuring-aperture is effected by opening usually shut bottom outlet of the aperture in a timed sequence and in accordance with their angular position when they are in vertically aligned relationship, an improvement which comprises:

1. a measure-holding turntable having substantially the same configuration, including measure-receiving openings which correspond to the measuring-apertures, as the superimposing filling-turntable and being supported coaxial and rotatable with the filling-turntable, but permitted of vertical displacement with respect to the filling-turntable;
2. a plurality of bottomless inner measures, each having a hollow of inverted frusto-conical section and a straight outer stem, the root portion of which is secured by each of said measure-receiving openings and the upper portion is telescopically inserted into each of the measuring-apertures to form a composite measure of varying capacity, and
3. a means for adjusting the height of the measure-holding turntable to vary the capacity of said composite measure which is dependent upon the distance between the turntables, simultaneously with that of the container placed underneath the apertures to combine the mouth of the container with the bottom of the aperture.

2. A powder filling machine in accordance with claim 1, wherein; both of the filling-turntable and the measure-holding turntable are carried on a common hub supported around the center shaft and combined with each other at the plurality of the circumferential positions with stems of the bottomless measures.

3. A powder filling machine in accordance with claim 1, wherein; the empty container is brought to be placed underneath the measuring-aperture with a combination comprising; (a) a cogged wheel supported around the center shaft between the measure-holding turntable and the base, rotatable with the turntables, and having a plurality of cogs, the numbers and respective positions of dents between the two adjacent cogs correspond to those of the measuring-apertures, (b) an arcuate guide plate installed on the base fencing a path for transferring the containers, to encircle the path with a space sufficient for receiving a container in the dent of the cogged wheel and the guide plate, and (c) a container lifting cam embedded in the base along the transferring path for the containers having a plateau of a height sufficient for lifting the container to place underneath the measuring-aperture during the sluicing period.

4. A powder filling machine in accordance with claim 3, wherein; the combination is associated with similar combinations of cogged wheels with guide plates, capable of passing empty containers and of removing filled containers one by one to and from the first mentioned combination.

5. A powder filling machine in accordance with claim 1, which further comprises; a means for adjusting the height of the measure-holding turntable simultaneously with that of the plateau of the container-lifting cam to maintain the distance between the measure-holding turntable and the plateau constant.

6. A powder filling machine in accordance with claim 5, wherein; the means for adjusting is operable during the continuance of the rotation of the turning elements.

7. A powder filling machine in accordance with claim 6, wherein the means for adjusting is a manual adjusting means.

8. A powder filling machine in accordance with claim 6, wherein the means for adjusting is an automatic adjusting means which automatically adjusts in accordance with the variance in the bulk density of the powder to be filled.

9. A powder filling machine in accordance with claim 1, which further comprises; a mean for evacuating to remove air from the empty or partly filled container placed underneath the aperture as a flow parallel to the inside wall of the container prior to or during the sluicing period.

10. A powder filling machine in accordance with claim 1, wherein; each of the bottom outlets of the composite measures is opened or shut with a slider suspended from the under surface of the measure-holding turntable and being radially displaceable in its suspended position, having (a) a flat face which serves as a shutter for the bottom outlet, (b) a chute which serves to interconnect the opened outlet with the mouth of 3the container placed underneath the measure, and (c) a means for engaging itself with a cam mounted around the center shaft capable of effecting the radial displacement.

11. A powder filling machine in accordance with claim 10, wherein; the slider further has (a) an annular suction inlet encircling the chute and being accommodated to the inside diameter of the mouth of the container for evacuating to remove air from the container, (b) an outwardly open outlet capable of accommodating itself to a suction junction of an exhausting means disposed outside the circumference of the turntable, and (c) a lengthwise conduit which connects (a) with (b) and permits the air to flow therethrough.

12. A powder filling machine in accordance with claim 11, wherein; the annular suction inlet is formed as a narrow endless slit between the lower end portion of the chute and a packing ring of elastic material affixed to the bottom face of the slider to encircle the chute.

13. A powder filling machine in accordance with claim 10, wherein; the means for engaging is a roller which follows a profile of the cam which acts to force the slider outwardly to align its chute with the aperture and with the container, and to make the outlet of the conduit to communicate with the suction junction to enable an evacuation of the empty container through the annular suction inlet.

14. A powder filling machine in accordance with claim 1, which further comprises; another turning element of a revolving turret being supported around the center shaft at its highest position rotatable simultaneously with the turntables and associated with an outside compressed-air supplying equipment, and having a plurality of vertical cylinders, the numbers and respective positions of which are identical with those of the supplying aperture; each of said cylinders slidably supports a scavenging gun capable of (a) moving to its most descended position where a nozzle head affixed to its lower end contacts with the surface of the filling-turntable to cover the respective supplying-aperture and of (b) blowing off to clean the supplying-aperture and the components beneath the aperture with the compressed-air as a spout parallel to the inside walls of these components.

15. A powder filling machine in accordance with claim 14, wherein; the vertical movement of the scavenging gun is effected by the rotation of the turret under the control of a cylindrical cam fixed to the center shaft.

16. A powder filling machine in accordance with claim 14, which further comprises; a distributor capable of supplying compressed-air from the associated supplying equipment to each of the scavenging guns to spout the air through the nozzle head in accordance with its angular and vertical positions in the timed sequence.

17. A powder filling machine in accordance with claim 16, wherein the distributor comprises at least one control valve interposed between the compressed-air supplying equipment and each of the scavenging guns capable of regulating the spout of air through the nozzle head and being actuatable by the rotation of the turret.

18. A powder filling machine in accordance with claim 14, wherein; the nozzle head of the scavenging gun is capable of spouting the compressed-air as an annular flow parallel to the inside wall of the nozzle head.

19. A powder filling machine in accordance with claim 18, wherein; the annular flow of the compressed-air is brought with a combination of the bottom opening of the nozzle head with a substantially cylindrical core suspended inside the opening, forming an annular slit which conforms to the diameter of the supplying-aperture through which the compressed air flows.

20. A powder filling machine in accordance with claim 14, wherein at least lower rigid end of the nozzle head is covered with a boot of elastic material capable of (a) absorbing shock caused by possible collision of the head with the surface of the filling-turntable and of (b) maintaining air-tightness between the head and the surface during a period wherein the gun is in its most descended position.

* * * * *